US008568159B2

(12) United States Patent
Noda et al.

(10) Patent No.: US 8,568,159 B2
(45) Date of Patent: Oct. 29, 2013

(54) CONNECTOR

(75) Inventors: Masahiro Noda, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 16 days.

(21) Appl. No.: 13/405,440

(22) Filed: Feb. 27, 2012

(65) Prior Publication Data

US 2012/0225587 A1 Sep. 6, 2012

(30) Foreign Application Priority Data

Mar. 4, 2011 (JP) ..... 2011-048050

(51) Int. Cl.
*H01R 13/58* (2006.01)

(52) U.S. Cl.
USPC ..... 439/470

(58) Field of Classification Search
USPC ..... 439/466, 468, 470, 473
See application file for complete search history.

(56) References Cited

U.S. PATENT DOCUMENTS

| | | | | |
|---|---|---|---|---|
| 4,448,471 | A * | 5/1984 | Berry et al. | 439/348 |
| 4,900,277 | A * | 2/1990 | Inaba et al. | 439/752 |
| 5,259,785 | A * | 11/1993 | Inaba et al. | 439/466 |
| 5,315,062 | A * | 5/1994 | Hoshino | 439/446 |
| 5,391,092 | A * | 2/1995 | Sumida | 439/470 |
| 5,586,909 | A * | 12/1996 | Saba | 439/559 |
| 5,688,144 | A * | 11/1997 | Kosuge | 439/596 |
| 5,759,063 | A * | 6/1998 | Beck et al. | 439/465 |
| 5,762,520 | A * | 6/1998 | Martin | 439/470 |
| 5,779,495 | A * | 7/1998 | Dechelette et al. | 439/353 |
| 5,897,392 | A * | 4/1999 | Takahashi et al. | 439/470 |
| 5,908,327 | A * | 6/1999 | Tsuji et al. | 439/470 |
| 5,967,830 | A * | 10/1999 | Tsuji | 439/470 |
| 6,019,638 | A * | 2/2000 | Saka et al. | 439/620.15 |
| 6,174,193 | B1 * | 1/2001 | Nagano | 439/468 |
| 6,203,362 | B1 | 3/2001 | Tsuji | |
| 6,350,147 | B2 * | 2/2002 | Brownell et al. | 439/468 |
| 6,478,607 | B2 * | 11/2002 | Tabata | 439/456 |
| 6,478,608 | B1 * | 11/2002 | Grant et al. | 439/468 |
| 6,540,547 | B2 * | 4/2003 | Zweigle | 439/468 |
| 6,824,420 | B2 * | 11/2004 | Ushiro et al. | 439/455 |
| 6,878,009 | B2 * | 4/2005 | Amemiya | 439/470 |
| 6,926,535 | B2 * | 8/2005 | Tsuji | 439/31 |
| 6,962,504 | B2 * | 11/2005 | Fukui et al. | 439/466 |
| 7,014,498 | B1 * | 3/2006 | Munoz | 439/473 |
| 7,021,959 | B2 * | 4/2006 | Tsuji et al. | 439/470 |

(Continued)

FOREIGN PATENT DOCUMENTS

| | | |
|---|---|---|
| JP | 2004-127813 | 4/2004 |
| JP | 2008293810 | 12/2008 |

*Primary Examiner* — Neil Abrams
(74) *Attorney, Agent, or Firm* — Gerald E. Hespos; Michael J. Porco; Matthew T. Hespos

(57) ABSTRACT

Areas at outer edge sides of a draw-out area for wires (13) out of a rear end surface (10R) of a housing (10) serve as operation surfaces (14) used to push the housing (10) forward. Areas of the outer periphery of a rear end portion of the housing (10) corresponding to and before the operation surfaces (14) are recessed to form outward forming grooves (15). The housing (10) is formed with bores (18) by further recessing parts of groove bottom surfaces (17) of the outward facing grooves (15). Inward facing projections (26) engageable with the outward facing grooves (15) are formed on the inner surface of a wire cover (20). Each locking projection (26) is formed with restricting projections (27) engageable with the bores (18).

7 Claims, 8 Drawing Sheets

(56) References Cited

U.S. PATENT DOCUMENTS

| | | | | |
|---|---|---|---|---|
| 7,201,592 | B2 * | 4/2007 | Hata | 439/206 |
| 7,422,470 | B2 * | 9/2008 | Tsuji | 439/470 |
| 7,476,121 | B2 * | 1/2009 | Tsuji | 439/471 |
| 7,537,479 | B2 * | 5/2009 | Miyamoto | 439/468 |
| 8,043,111 | B2 * | 10/2011 | Takahashi et al. | 439/464 |
| 8,192,229 | B2 * | 6/2012 | Endo | 439/596 |
| 8,435,068 | B2 * | 5/2013 | Oomori | 439/465 |
| 2003/0199193 | A1 | 10/2003 | Amemiya | |
| 2012/0135640 | A1 | 5/2012 | Oomori | |
| 2012/0225587 | A1 * | 9/2012 | Noda et al. | 439/626 |

* cited by examiner

CONNECTOR

BACKGROUND OF THE INVENTION

1. Field of the Invention

The invention relates to a connector.

2. Description of the Related Art

Japanese Unexamined Patent Publication No. 2004-127813 discloses a connector with a housing formed that has terminal accommodating chambers and a wire cover to be mounted on a rear end of the housing to surround wires drawn out from the housing. Left and right locking projections are formed on opposite left and right surfaces of the housing and left and right locking holes are formed in opposite left and right walls of the wire cover to engage the locking projections for holding the housing and the wire cover in an assembled state. The engagement of the locking projections and the locking holes when the wire cover is assembled with the housing prevents relative displacements of the housing and the wire cover in forward and backward directions and vertical directions. Rear surfaces of the locking projections are continuous and flush with the rear end surface of the housing, and the rear end surface of the housing and the rear surfaces of the locking projections define an operation surface to be pushed by placing fingers in connecting the housing to a mating connector.

The requirement of the locking projections to fit in the locking holes of the above-described connector limits the vertical dimension for the locking projections. Thus, the areas of the rear surfaces of the locking projections must be small and the area of the entire operation surface also is small.

The invention was completed in view of the above situation and an object thereof is to ensure a large area of an operation surface on the rear end surface of the housing.

SUMMARY OF THE INVENTION

The invention relates to a connector with a housing that has one or more terminal accommodating chambers and a rear end surface from which one or more wires are to be drawn out. A wire cover is mounted on the outer periphery of a rear end of the housing to at least partly surround the wires. An area of the rear end surface of the housing at an outer edge of a draw-out area for the wires defines at least one operation surface to push the housing forward. At least one locking recess is formed at an area of the outer periphery of the rear end of the housing before the operation surface and at least one bore is formed in the housing by further recessing part of the back surface of the locking recess. At least one locking projection is formed on the inner surface of the wire cover and engages the locking recess to prevent displacement of the wire cover relative to the housing in forward and backward directions. The locking projection is formed with at least one restricting projection for engaging the bore to prevent displacements of the wire cover relative to the housing in a direction substantially parallel to the operation surface.

The engagement of the locking recess and the locking projection prevents displacement of the wire cover relative to the housing in forward and backward directions. The engagement of the restricting projection and the bore prevents displacements relative to the housing parallel to the operation surface. The locking recess of the housing defines a locking means with the wire cover and is arranged in an area of the outer peripheral surface of the housing before the operation surface. Thus, the area of the operation surface is not reduced by the formation of the locking recess.

The locking recesses preferably is a groove that is substantially parallel to an assembling direction of the wire cover and opposite ends of the locking recess in the assembling direction are exposed at the outer periphery of the housing. Thus, the wire cover can be assembled with the housing in a direction parallel to the operation surface and the locking recess guides the assembly the wire cover.

The restricting projection preferably comprises a restricting surface substantially perpendicular to the assembling direction of the wire cover and a guiding surface is formed in an area behind the restricting surface in the assembling direction and is inclined oblique to the assembling direction of the wire cover.

The wire cover preferably comprises first and second cover portions connected by at least one hinge and being pivotable with respect to each other.

The cover preferably is assembled to the housing by first assembling the first cover portion with the housing. Displacements relative to the housing in forward and backward directions are prevented by the engagement of the locking recess and the locking projection and displacements relative to the housing in the assembling direction parallel to the operation surface are prevented by the engagement of the restricting projection and the bore. The second cover portion then is closed.

The second cover portion preferably includes a second wall corresponding at least to the front end part of a first wall of the first cover portion.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 1:
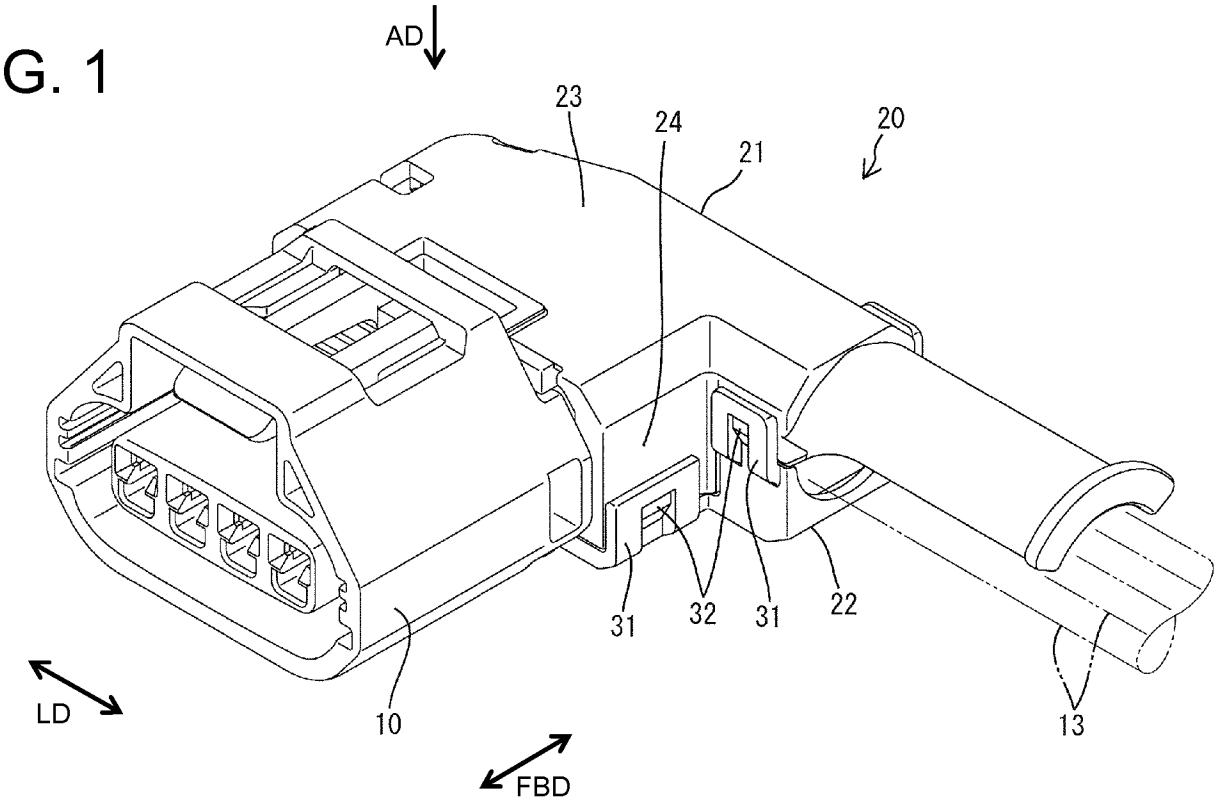
FIG. 1 is a perspective view of a wire cover assembled with a housing in one embodiment of the invention.
Figure 2:
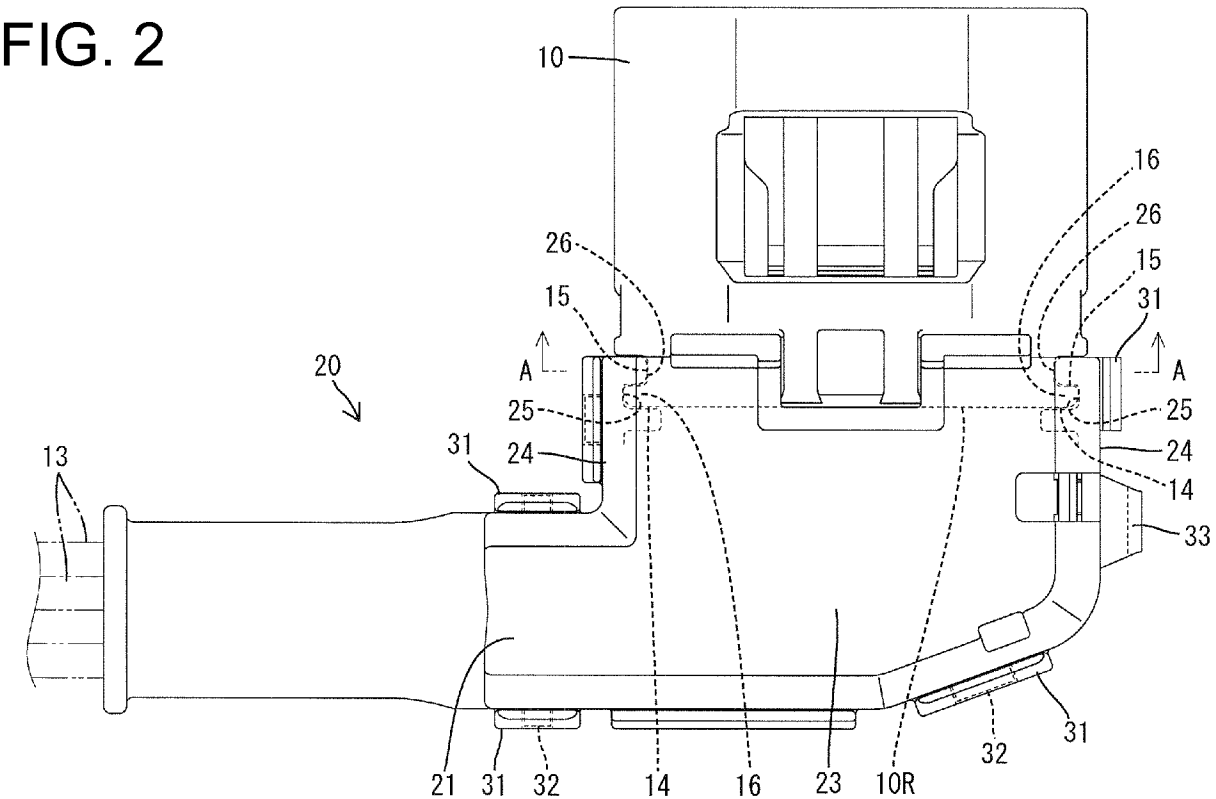
FIG. 2 is a plan view showing the wire cover assembled with the housing.

A connector in accordance with the invention includes a housing 10 made e.g. of synthetic resin and a wire cover 20 to be mounted on a rear end of the housing 10, as shown in FIGS. 1 and 2. The connector is designed to ensure large areas of operation surfaces 14 on a rear end surface 10R of the housing 10.

Figure 3:
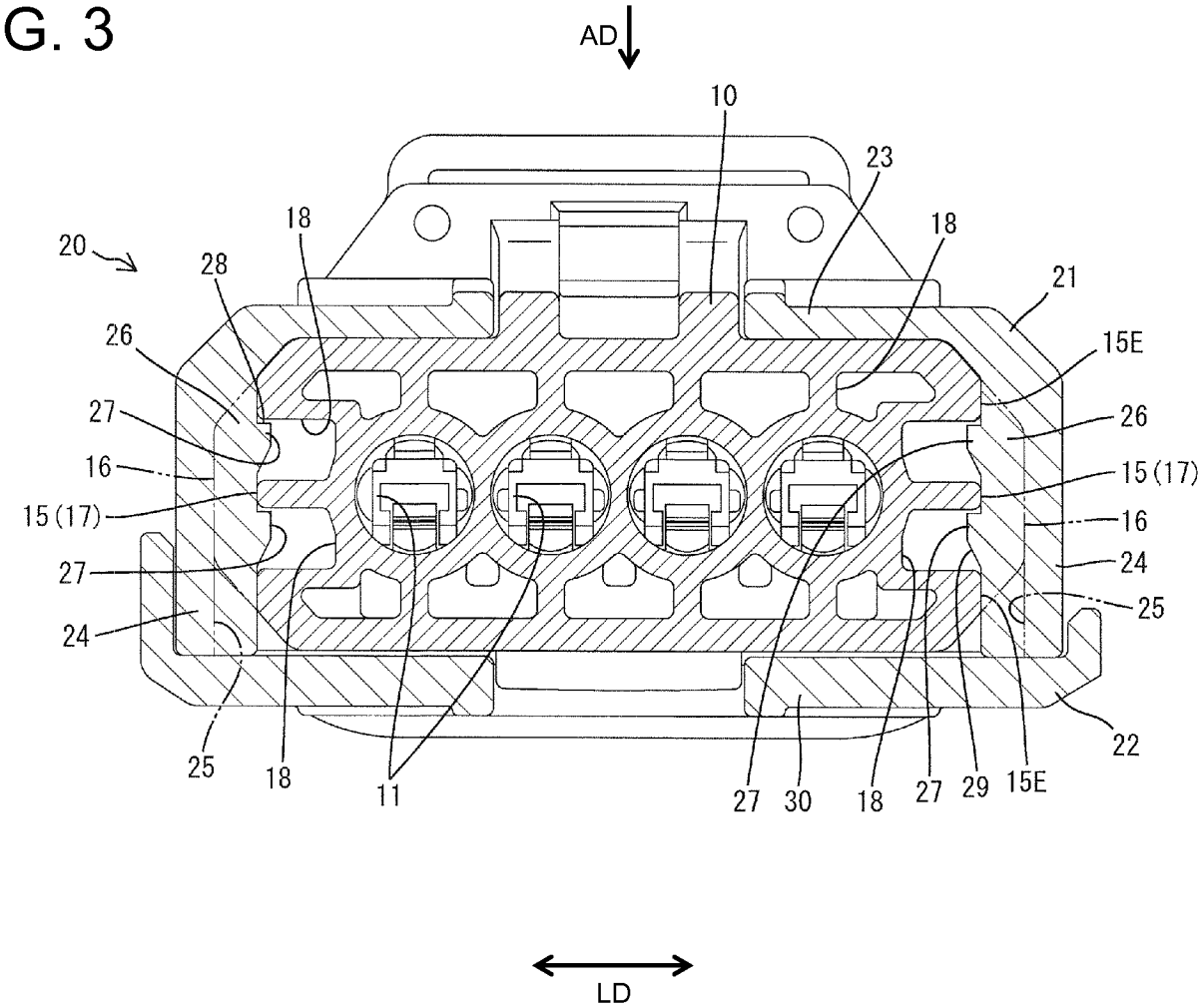
FIG. 3 is a section along A-A of FIG. 2.
Figure 4:
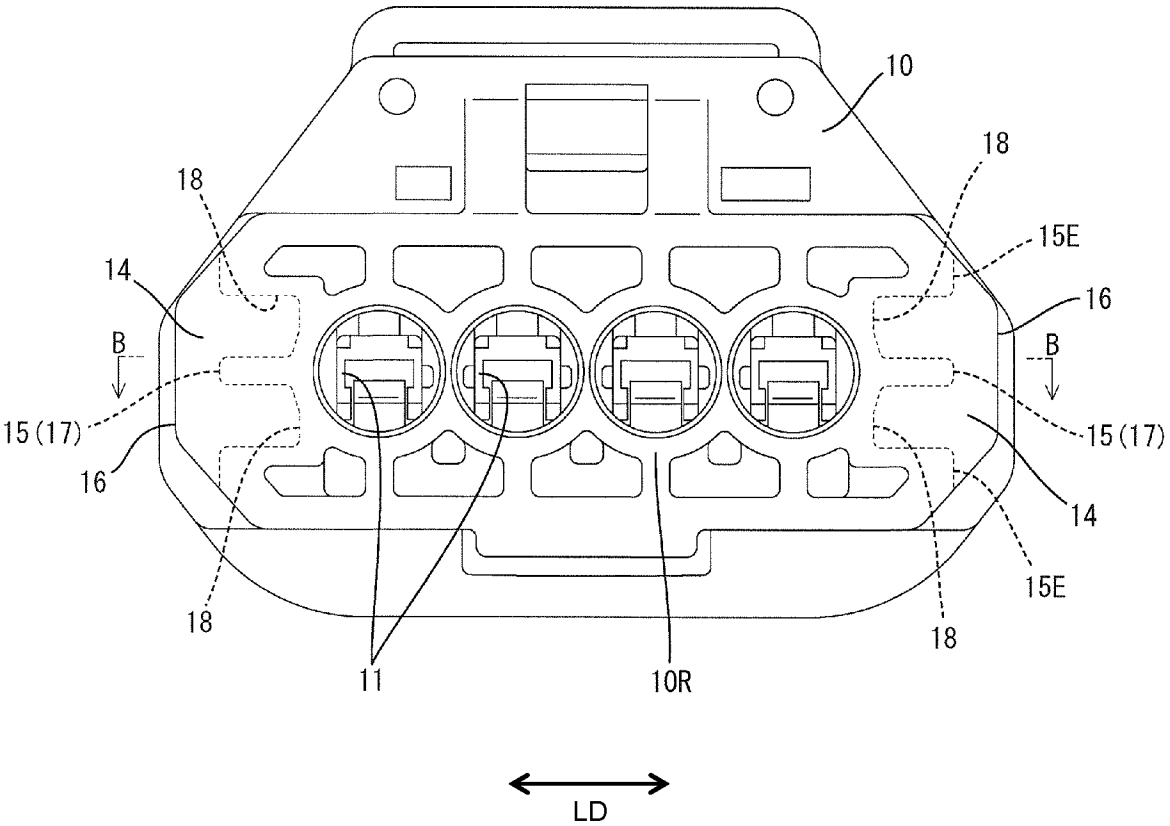
FIG. 4 is a rear view of the housing.
Figure 6:
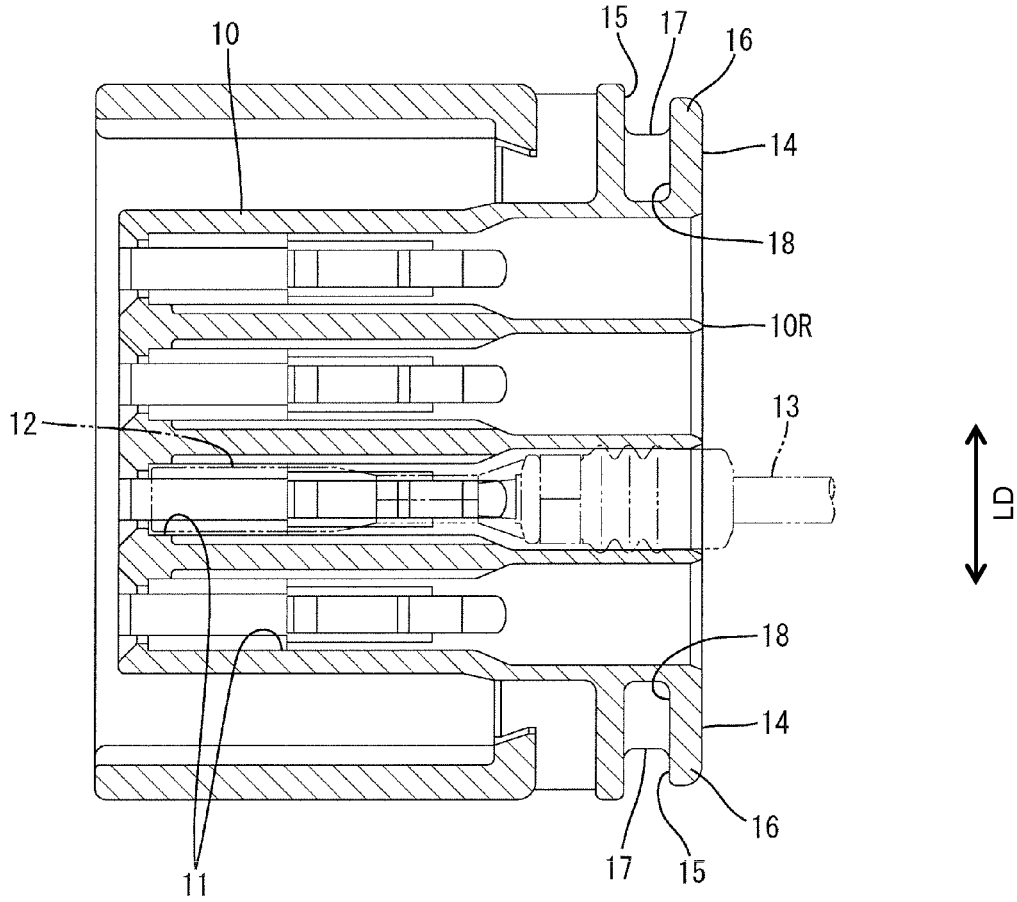
FIG. 6 is a section along B-B of FIG. 4.

As shown in FIGS. 3, 4 and 6, terminal accommodating chambers 11 are formed side by side in a lateral direction LD in FIGS. 3 and 4 (vertical direction in FIG. 6) and penetrate the housing 10 in forward and backward directions FBD (lateral direction in FIG. 6). As shown in FIG. 6, a terminal fitting 12 is inserted into each terminal accommodating chamber 11 from behind the housing 10 (from right side in FIG. 6). A wire 13 is connected to a rear part of each terminal fitting 12 inserted in the terminal accommodating chambers 11 and the wires 13 are drawn out backward from the rear end surface 10R of the housing 10 while spreading in the lateral direction. As shown in FIGS. 1 and 2, the wires 13 drawn out from the housing 10 pass through the wire cover 20.

Substantially bilaterally symmetric operation surfaces 14 are formed at opposite left and right sides of the rear end surface 10R of the housing 10 laterally of a draw-out area for the wires 13, as shown in FIGS. 2, 4 to 6. The operation surfaces 14 define areas where an operator can place his fingers to push the housing 10 forward toward a mating connector for connection with the mating connector (not shown).

Figure 5:
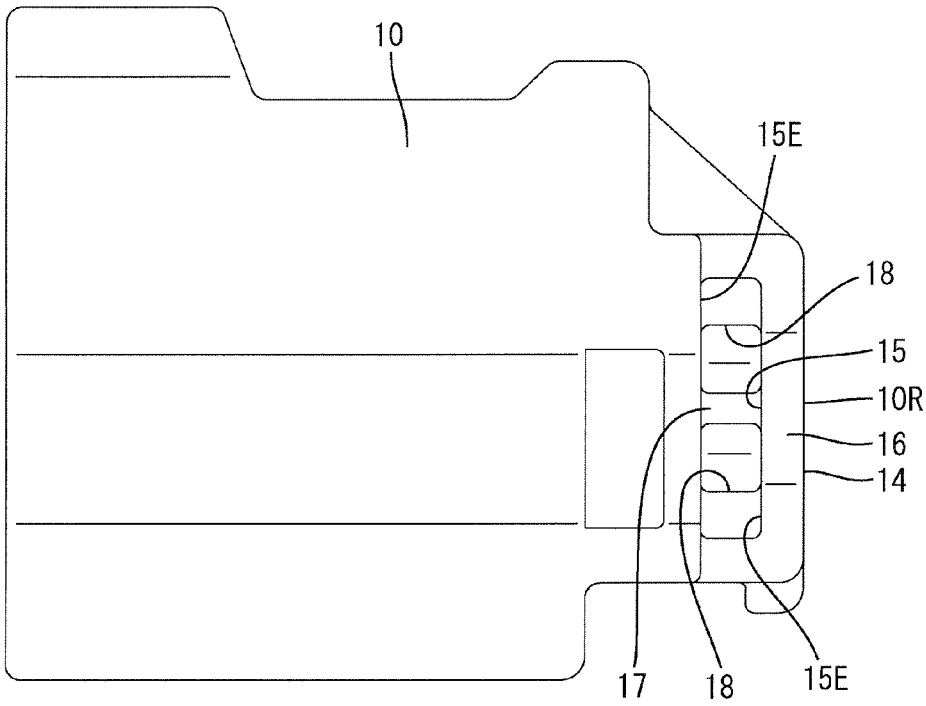
FIG. 5 is a side view of the housing.

Substantially bilaterally symmetric outward facing grooves 15 are recessed in the opposite left and right outer surfaces of the rear end portion of the housing 10, as shown in FIGS. 2, 4 to 6. The outward facing grooves 15 extend vertically and substantially parallel to an assembling direction AD of an upper cover 21 with the housing 10. Opposite ends 15E of the outward facing grooves 15 in the vertical direction (assembling direction AD of the upper cover 21) are exposed at the upper and lower surfaces of the housing 10, as shown in FIGS. 4 and 5. The outward facing grooves 15 are arranged in areas before the operating surfaces 14 on the rear end surface 10R of the housing 10 in forward and backward directions FBD, as shown in FIGS. 2, 4 to 6. Substantially bilaterally symmetric outward facing projections 16 extend vertically and project laterally out like ribs between the operation surfaces 14 and the outward facing grooves 15 on an outer peripheral portion of the rear end of the housing 10. The front and rear surfaces of the outward facing projections 16 are substantially flat and parallel to each other.

Bores 18 are formed by further recessing groove bottom surfaces 17 of the left and right outward facing grooves 15 at the rear end portion of the housing 10, as shown in FIGS. 3, 4 and 6. The bores 18 are formed by molds (not shown) that are opened in the lateral direction LD (i.e. direction perpendicular to the assembling direction AD of the upper cover 21 and parallel to the operation surfaces 14. The opening edges of the bores 18 in the groove bottom surfaces 17 define right-angular steps. Each outward facing groove 15 has two bores 18 arranged one above the other.

As shown in FIGS. 1, 3, 7 and 8, the wire cover 20 is formed e.g. of synthetic resin and has the upper cover 21 united with a lower cover 22 to define a tube bent substantially normal to the forward and backward directions FBD. A front end portion of the wire cover 20 is mounted on the rear end portion of the housing 10, as shown in FIGS. 1 and 2. Thus, the wires 13 drawn out backward from the housing 10 are bent in the wire cover 20 to extend substantially parallel to the rear end surface 10R of the housing 10 and are drawn out of the wire cover 20.

Figure 7:
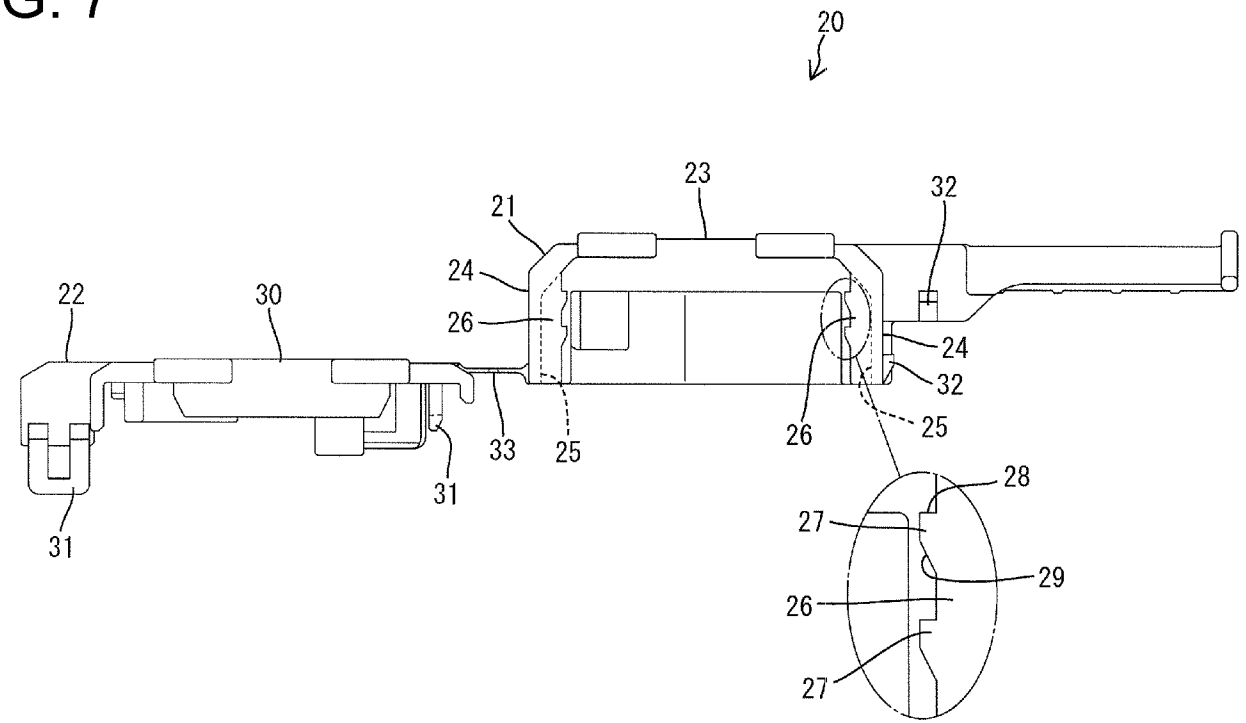
FIG. 7 is a front view showing a state before the wire cover is assembled with the housing.
Figure 8:
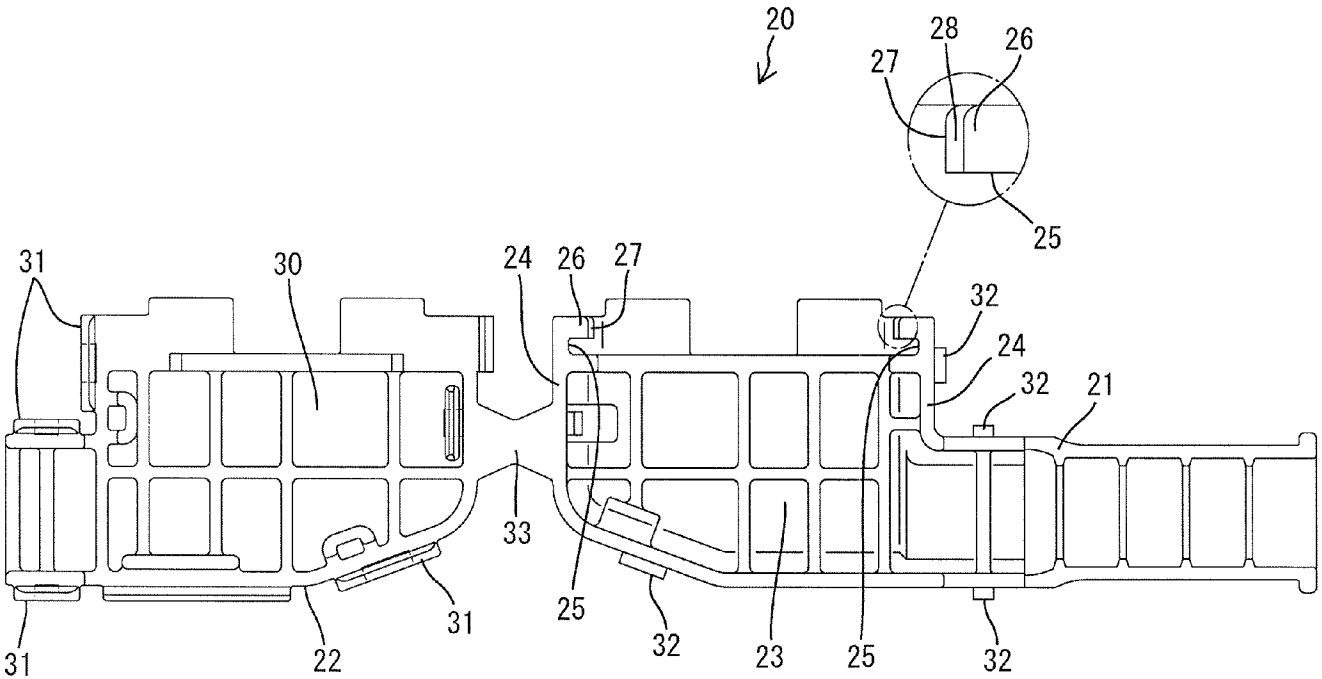
FIG. 8 is a bottom view showing the state before the wire cover is assembled with the housing.

The upper cover 21 includes an upper wall 23 and left and right side walls 24 that extend down from opposite left and right edges of a front end of the upper wall 23, as shown in FIGS. 1, 3, 7 and 8. The inner surfaces of front end portions of the left and right side walls 24 are recessed to form substantially bilaterally symmetric inward facing grooves 25, as shown in FIGS. 2 and 8. The inward facing grooves 25 extend up and substantially parallel to the assembling direction AD of the upper cover 21 with the housing 10 from the lower end surfaces of the side walls 24. Bilaterally symmetric inward facing projections 26 are formed on the side walls 24 of the upper cover 21 between the front end surface of the upper cover 21 and the front surfaces of the inward facing grooves 25 to form vertically extending ribs that and project laterally in.

As shown in FIGS. 3, 7 and 8, upper and lower restricting projections 27 are formed on the projecting end surface of each of the left and right inward facing projections 26. A restricting surface 28 is formed on the top end of each restricting projection 27 and extends substantially perpendicular to the assembling direction AD of the upper cover 21. A guiding inclined surface 29 is formed below the restricting surface 28 of each restricting projection 27 and extends oblique to the assembling direction AD of the upper cover 21 to face substantially toward the groove bottom surface 17 of the outward facing groove 15.

The lower cover 22 includes a lower wall 30 corresponding at least to the front end part of the upper wall 23 of the upper cover 21, as shown in FIG. 3. Resilient locking pieces 31 extend up from the outer peripheral edge of the lower wall 30, as shown in FIGS. 1, 2, 7 and 8. The resilient locking pieces 31 are to engage respective lock projections 32 of the upper cover 21 when the upper cover 21 and the lower cover 22 are united or closed so that the two covers 21, 22 are locked in a united or closed state. As shown in FIGS. 2, 7 and 8, a right edge of a front end of the lower cover 22 is connected unitarily to a right edge of the front end of the upper cover 21 via a hinge 33.

The upper cover 21 initially is assembled with the housing 10 from above and in an assembling direction AD. At this time, the inward facing projections 26 of the upper cover 21 are fit into the outward facing grooves 15 of the housing 10 and the outward facing projections 16 of the housing 10 are fit into the respective inward facing grooves 25 of the upper cover 21. In the assembling process, the upper cover 21 is guided with respect to the housing 10 with relative displacements in forward and backward directions FBD prevented, and smoothly assembled by the engagement of the grooves 15, 25 and the projections 16, 26. Further, the restricting projections 27 slide in contact with the groove bottom surfaces 17 of the outward facing grooves 15. As a result, the left and right side walls 24 of the upper cover 21 temporarily resiliently deform to move slightly away from each other in the lateral direction LD.

The upper wall 23 contacts the upper surface of the housing 10 when the upper cover 21 reaches a proper assembled position with respect to the housing 10, as shown in FIG. 3, thereby preventing any further downward movement of the upper cover 21 in the assembling direction AD. The left and right side walls 24 resiliently restore when the proper assembled position is reached and, accordingly, the restricting projections 27 enter the bores 18 and the restricting surfaces 28 engage the upper opening edges of the bores 18. As a result, the upper cover 21 is prevented from moving up relative to the housing 10. Accordingly, the upper cover 21 is locked with the housing 10 in a state where relative displacements in forward and backward directions FBD and vertical direction are prevented.

The lower cover 22 then is rotated about the hinge 33 to be united with the upper cover 21 while the hinge 33 is deformed and folded. The resilient locking pieces 31 engage the respective lock projections 32 when the lower cover 22 reaches a proper united position so that the lower cover 22 is locked in the closed state with the upper cover 21 to form the wire cover 20. The assembly of the wire cover 20 with the housing 10 is completed when the upper and lower covers 21, 22 are closed.

The operation surfaces 14 are defined at the rear end surface 10R of the housing 10 laterally of the draw-out area for the wires 13. The operation surfaces 14 are used to push the housing 10 forward and therefore should be large. Accordingly, the areas of the outer periphery of the rear end portion of the housing 10 corresponding to and before the operation surfaces 14 are recessed to form the outward facing grooves 15. The bores 18 are formed by further recessing parts of the groove bottom surfaces 17 of the outward facing grooves 15.

The inward facing projections 26 on the side walls 24 of the upper cover 21 engage the outward facing grooves 15 to prevent displacements of the upper cover 21 relative to the housing 10 in forward and backward directions FBD. Additionally, the restricting projections 27 of the inward facing projections 26 engage the bores 18 to prevent displacements of the upper cover 21 relative to the housing 10 parallel to the vertical assembling direction AD of the upper cover 21 with the housing 10.

According to this construction, the engagement of the outward facing grooves 15 and the inward facing projections 26 prevent displacements of the upper cover 21 relative to the housing 10 in forward and backward directions FBD and the engagement of the restricting projections 27 and the bores 18 prevent displacements relative to the housing 10 in the upward direction parallel to the operation surfaces 14. In this way, the outward facing grooves 15 of the housing 10 define the locking means with the upper cover 21 and are arranged in the areas of the outer peripheral surface of the housing 10 before the operation surfaces 14. Therefore the outward facing grooves 15 do not reduce the areas of the operation surfaces 14.

The upper cover 21 is assembled with the housing 10 in the vertical assembling direction and substantially parallel to the operation surfaces 14. The outward facing grooves 15 are substantially parallel to the assembling direction AD of the upper cover 21, and the opposite ends 15E thereof in the assembling direction AD are exposed at the outer peripheral surface of the housing 10. The alignment of the outward facing grooves 15 parallel to the assembling direction AD of the upper cover 21 enable the outward facing grooves to guide the assembly the wire cover 20.

The invention is not limited to the above described embodiment. For example, the following embodiments also are included in the scope of the invention.

The locking recesses fulfill the guide function in assembling the wire cover with the housing in the above embodiment, but they may not fulfill such a function.

The locking recesses are grooves and the opposite ends thereof in the assembling direction of the wire cover are exposed at the outer peripheral surface of the housing in the above embodiment. However, opposite ends of the locking recesses in the assembling direction may not be exposed at the outer peripheral surface of the housing.

Although the bores are at two positions in one locking recess in the above embodiment, one, three or more bores may be formed in one locking recess.

Although the locking projections are formed only on the upper cover in the above embodiment, they may be formed both on the upper cover and on the lower cover.

Two locking recesses and two locking projections are provided in the above embodiment. However, other numbers of locking recesses and locking projections may be provided.

What is claimed is:

1. A connector, comprising:

a housing with a rear end, terminal accommodating chambers forward of the rear end, a wire draw out area at the rear end and communicating with the terminal accommodating chambers, parts of the rear end laterally of the wire draw out area defining at least one operation surface for pushing the housing forward, at least one locking recess forward of the operation surface and at least one bore recessed in a part of the locking recess; and a wire cover mounted on the rear end of the housing and at least partly surrounding the wire draw out area, at least one locking projection formed on an inner surface of the wire cover and engaging the locking recess to prevent displacements of the wire cover relative to the housing in forward and backward directions, at least one restricting projection formed on the locking projection and engaging the bore to prevent displacements of the wire cover relative to the housing in an assembly direction substantially parallel to the operation surface.

2. The connector of claim 1, wherein the wire cover is assembled with the housing in the assembly direction parallel to the operation surface.

3. The connector of claim 2, wherein the locking recess is a groove substantially parallel to the assembling direction of the wire cover and opposite ends of the locking recess in the assembling direction are exposed at an outer peripheral surface of the housing.

4. The connector of claim 3, wherein the restricting projection comprises a restricting surface substantially perpendicular to the assembling direction of the wire cover and a guiding inclined surface oblique to the assembling direction and formed in an area behind the restricting surface in the assembling direction.

5. The connector of claim 1, wherein the wire cover comprises a first cover portion and a second cover portion connected by at least one hinge and being pivotable with respect to each other.

6. The connector of claim 5, wherein the first cover portion has the locking projection and the restricting projection.

7. The connector according to claim 6, wherein the second cover portion includes a second wall portion corresponding at least to a front end part of a first wall portion of the first cover portion.

* * * * *